US006411024B1

(12) United States Patent
Arimoto

(10) Patent No.: US 6,411,024 B1
(45) **Date of Patent: *Jun. 25, 2002**

(54) COLOR PICTURE TUBE

(75) Inventor: Nozomu Arimoto, Osaka (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/250,117

(22) Filed: Feb. 16, 1999

(30) Foreign Application Priority Data

Feb. 26, 1998 (JP) ..... 10-045722

(51) Int. Cl.[7] ..... H01J 29/07
(52) U.S. Cl. ..... 313/402; 313/407; 313/408
(58) Field of Search ..... 313/402, 403, 313/404, 405, 407, 408; 445/30

(56) References Cited

U.S. PATENT DOCUMENTS

| | | | | | |
|---|---|---|---|---|---|
| 4,748,370 | A | | 5/1988 | van den Broek | |
| 4,926,089 | A | | 5/1990 | Moore | |
| 4,994,712 | A | * | 2/1991 | Strauss | 313/407 |
| 5,214,349 | A | * | 5/1993 | Sakata et al. | 313/407 |
| 5,408,158 | A | * | 4/1995 | Hens et al. | 313/402 |
| 5,416,380 | A | * | 5/1995 | Horiuchi | 313/407 |
| 5,554,909 | A | * | 9/1996 | Brennesholtz | 313/402 |
| 5,742,116 | A | * | 4/1998 | Maki et al. | 313/402 |
| 5,801,479 | A | | 9/1998 | Shinoda | |
| 6,111,349 | A | * | 8/2000 | Kuwana et al. | 313/407 |
| 6,144,149 | A | * | 11/2000 | Youn et al. | 313/407 |

FOREIGN PATENT DOCUMENTS

| | | | | |
|---|---|---|---|---|
| EP | 0 121 628 A1 | | 10/1984 | |
| JP | 411250824 A | * | 9/1999 | 313/402 |
| WO | WO 92/12525 | | 7/1992 | |

* cited by examiner

*Primary Examiner*—Ashok Patel
(74) *Attorney, Agent, or Firm*—Merchant & Gould PC

(57) ABSTRACT

A color picture tube for which a light-weight support frame for holding a shadow mask can be used and whose weight can be reduced, and a color picture tube that can be provided without requiring the use of a press mold, and a press machine for producing a shadow mask. The tension applied to the shadow mask is 5–90% of the tension (full tension) that would be applied to the shadow mask to prevent electron beams from arriving at a position that is shifted from a predetermined arrival position on the phosphor screen surface due to the thermal expansion of the shadow mask caused by absorbing thermal energy that is converted from the energy of electron beams when electron beams strike the shadow mask.

11 Claims, 6 Drawing Sheets

COLOR PICTURE TUBE

FIELD OF THE INVENTION

The present invention relates to a color picture tube used for a television set or a computer display, and more particularly relates to a shadow mask used for controlling the arrival position of an electron beam that is emitted from an electron gun.

BACKGROUND OF THE INVENTION

As shown in FIG. 5, in general, a color picture tube comprises a face panel 2, a funnel 3, an electron gun 5, a deflection yoke 6 and a shadow mask 7. The face panel 2 is substantially rectangular and has a phosphor screen surface 2*a* formed inside thereof. The funnel 3 is connected to the rear part of the face panel 2. The electron gun 5 is provided inside of a neck portion 3*a* of the funnel 3. The deflection yoke 6 is attached to the periphery of the funnel 3. The shadow mask 7 is provided inside of the face panel 2 facing the phosphor screen surface 2*a*.

The shadow mask 7 has a plurality of electron beam through apertures which are arranged regularly, and has the function of sorting three electron beams 4 emitted from the electron gun 5 based on color. press mask as shown in FIG. 6(*a*) that is formed by pressing to form a predetermined curved surface beforehand, a flat mask as shown in FIG. 6(*b*) that is formed by using a flat member without processing, a cylindrical mask as shown in FIG. 6(*c*) that is formed by curving a flat member along the longer axis or along the shorter axis, a shadow mask comprising a frame and a plurality of stripe-shaped materials, wherein the plurality of stripe-shaped materials are pulled with tension and are welded to fix to the frame (refer to Unexamined Japanese Patent Application No. Tokkai Hei 4-163830) and the like are well known as examples of a shadow mask.

Recently, a face panel constituting a color picture tube tends to be flattened because the flat face panel is not affected by outside light and the appearance of a color picture tube comprising the flat face panel is sophisticated. As a face panel tends to be flattened, its shadow mask also tends to be flattened. Therefore, when electron beams strike the shadow mask, the energy of the electron beams is converted into thermal energy, the shadow mask absorbs the thermal energy and the electron beam through apertures formed on the shadow mask are shifted due to the thermal expansion of the shadow mask caused by absorbing the thermal energy. As a result, the electron beams that pass through the electron beam through apertures can't strike the phosphor substance accurately so as to cause irregularity of a color. That is, a so-called doming phenomenon occurs. Furthermore, as the shadow mask is flattened greatly, the degree of thermal expansion of the shadow mask becomes increased, and the problem of irregularity of a color caused by the doming phenomenon becomes more serious. In order to solve the above-mentioned problem, in a case of a flat mask and a cylindrical mask, tension that is stronger than the intensity of the thermal expansion caused by temperature increase of the shadow mask is applied in the directions shown by arrows as shown in FIGS. 6(*b*) and (*c*) so that positions of the electron beam through apertures formed on the shadow mask are not shifted from positions of phosphor dots formed on the phosphor screen surface which are supposed to be matched to each other.

However, in a case of a conventional tension mask such as a flat mask and a cylindrical mask, during the operation of a color picture tube, sufficient tension is applied not to cause the doming phenomenon of the shadow mask and prevent electron beams from arriving at a position that is shifted from a predetermined position due to the doming phenomenon of the shadow mask. Therefore, a heavy and strong support frame for holding a shadow mask is required and the weight of a color picture tube itself increases.

On the other hand, in a case of a color picture tube comprising a press mask as a shadow mask, a pressing mold and a pressing machine are required for producing the press mask, and therefore the cost for producing the color picture tube can't be reduced.

SUMMARY OF THE INVENTION

It is the object of the present invention to overcome the problems of the prior art by providing (i) a color picture tube, wherein a light-weight support frame for holding a shadow mask can be used and the weight of the color picture tube can be reduced, and (ii) a color picture tube comprising a shadow mask that can be produced without using a pressing mold and a pressing machine.

In order to achieve the above object, a configuration of a color picture tube according to the present invention comprises a face panel having a phosphor screen surface formed inside, a funnel that is connected to the rear part of the face panel, an electron gun that is provided inside of a neck portion of the funnel and a shadow mask that has a plurality of electron beam through apertures for passing electron beams emitted from the electron gun. The shadow mask is positioned a predetermined distance from the phosphor screen surface. The tension applied to the shadow mask is such that the shadow mask has a tension that is 5–90% of the tension that would be applied to the shadow mask to prevent electron beams from arriving at a position that is shifted from a predetermined position of the phosphor screen surface due to the thermal expansion caused by absorbing thermal energy that is converted from the energy of electron beams when electron beams strike the shadow mask.

According to the above-mentioned configuration of the color picture tube of the present invention, the distance by which electron beams shift between a predetermined arrival position and an actual arrival position on the phosphor screen surface is reduced enough so as to matter for practical use. Consequently, the degree of irregularity of a color becomes irrelevant for practical use. As a result, a light-weight frame having the low strength can be used for holding the shadow mask with tension. Consequently, the weight of a color picture tube itself can be reduced and the design of the color picture tube can be simplified. Furthermore, a conventional large-scale machine for holding a shadow mask with tension is not required because the intensity of the tension that is applied to the shadow mask is small. Furthermore, unlike the conventional case producing a press mask, the shadow mask can be produced easily without using a pressing mold and a pressing machine.

In the above-mentioned configuration of the color picture tube according to the present invention, it is preferable that the tension applied to the shadow mask is such that the shadow mask has a tension that would be 40–60% of the tension that would be applied to the shadow mask to prevent electron beams from arriving at a position that is shifted from a predetermined position of the phosphor screen surface due to the thermal expansion caused by absorbing thermal energy that is converted from the energy of electron beams when electron beams strike the shadow mask. According to this preferable example, irregularity of a color can be further avoided.

In the above-mentioned configuration of the color picture tube according to the present invention, it is preferable that the tension is applied to the shadow mask so that the maximum distance by which electron beams shift between a predetermined arrival position and an actual arrival position on the phosphor screen surface due to the thermal expansion of the shadow mask caused by absorbing thermal energy that is converted from the energy of electron beams when electron beams strike the shadow mask is 100 $\mu$m or less. According to this preferable example, during the broadcast of television and under the conditions of ordinary use of the display, the level of the irregularity of a color can be reduced so as not to matter for practical use.

In the above-mentioned configuration of the color picture tube according to the present invention, it is preferable that the shadow mask is made of invar material and the tension that is applied to the shadow mask is 1–2 kg/mm$^2$.

In the above-mentioned configuration of the color picture tube according to the present invention, it is preferable that a frame for attaching the shadow mask is further provided, and the shadow mask is firmly held under tension by the frame.

In the above-mentioned configuration of the color picture tube according to the present invention, it is preferable that a frame for attaching the shadow mask is further provided, and the frame has means for generating tension to hold a shadow mask. In this case, it is preferable that the frame comprises the upper frame and the lower frame, the spring members are provided to separate the upper and lower frames at the both sides of the pair of frames.

In the above-mentioned configuration of the color picture tube according to the present invention, it is preferable that a shadow mask is flat.

In the above-mentioned configuration of the color picture tube according to the present invention, it is preferable that a shadow mask is curved along the longer axis or along the shorter axis.

In the above-mentioned configuration of the color picture tube according to the present invention, it is preferable that the inner surface and the outer surface of the face panel are substantially flat.

In the above-mentioned configuration of the color picture tube according to the present invention, it is preferable that the inner surface and the outer surface of a face panel are curved.

In the above-mentioned configuration of the color picture tube according to the present invention, it is preferable that the inner surface and the outer surface of the face panel are curved along the longer axis or along the shorter axis.

In the above-mentioned configuration of the color picture tube according to the present invention, it is preferable that the outer surface of the face panel is flat and the inner surface of the face panel is curved.

In the above-mentioned configuration of the color picture tube according to the present invention, it is preferable that the outer surface of the face panel is flat and the inner surface of the face panel is curved along the longer axis or along the shorter axis.

DESCRIPTION OF THE PREFERRED EMBODIMENTS

The preferred embodiments of the present invention are described below, with reference to the drawings.

Figure 1:
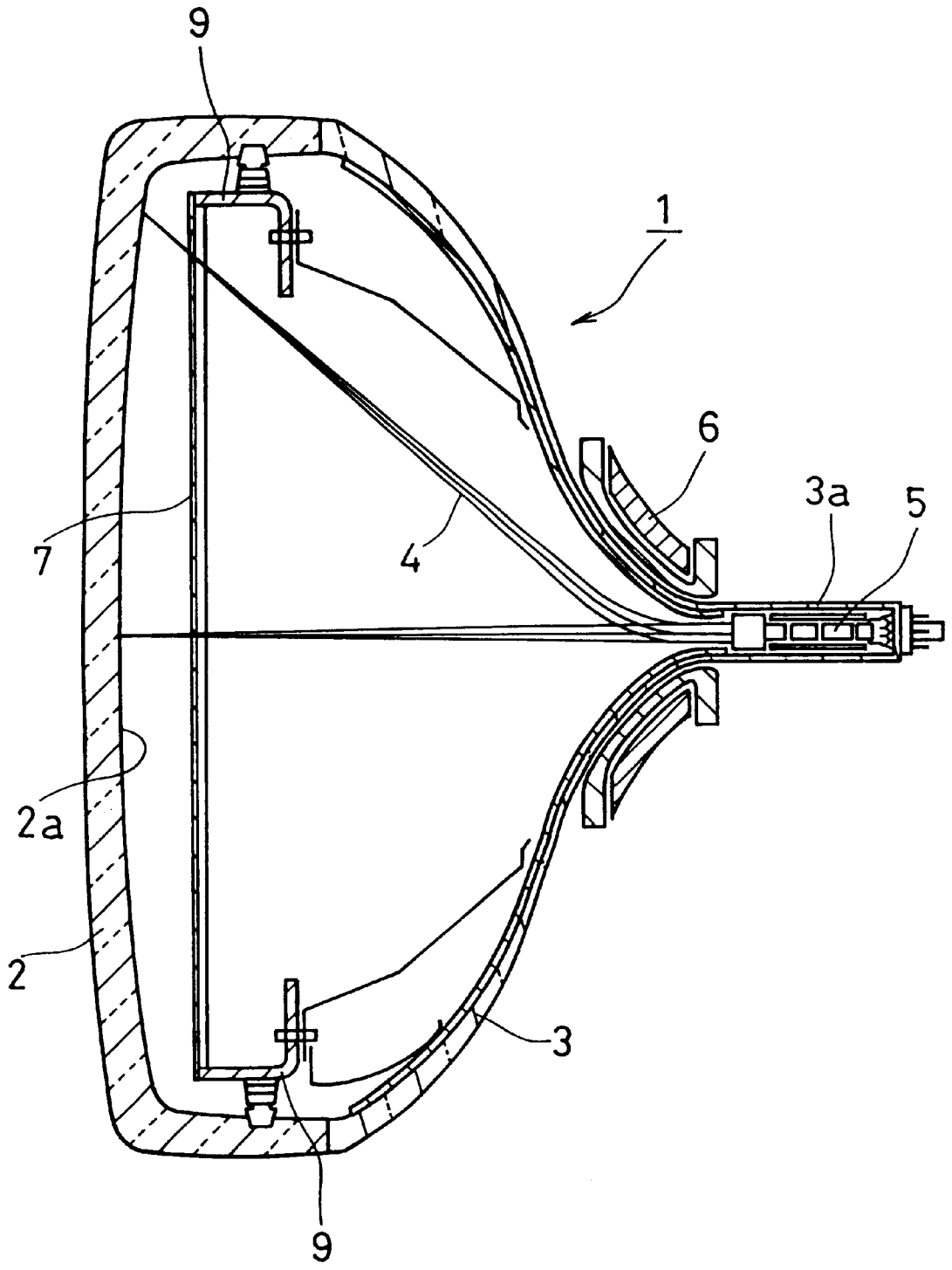
FIG. 1 is a vertical sectional view showing a color picture tube according to an embodiment of the present invention.
Figure 2:
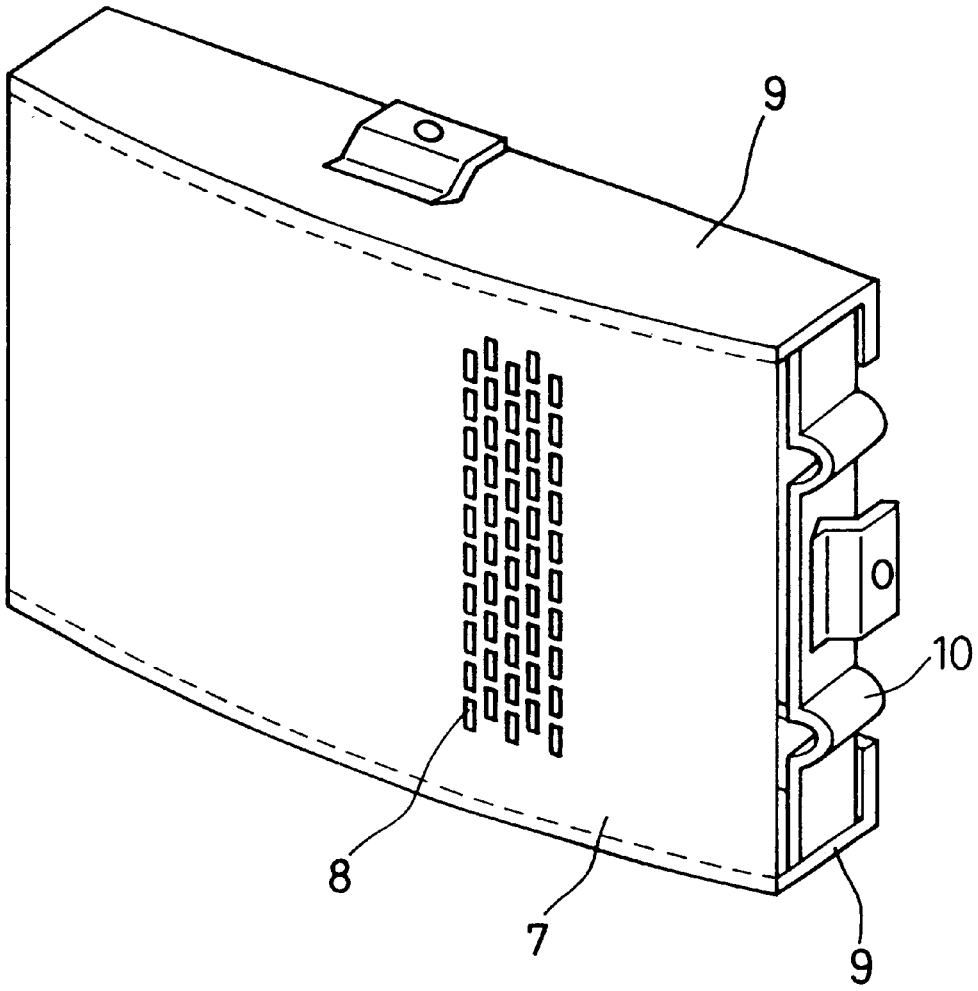
FIG. 2 is a perspective view showing a shadow mask unit of a color picture tube according to an embodiment of the present invention.

FIG. 1 is a vertical sectional view showing a color picture tube according to an embodiment of the present invention. FIG. 2 is a perspective view showing a shadow mask unit of a color picture tube according to an embodiment of the present invention.

As shown in FIG. 1, the color picture tube 1 according to an embodiment of the present invention comprises a face panel 2, a funnel 3, an electron gun 5, a deflection yoke 6 and a shadow mask 7. The face panel 2 is made of glass and has a curved inner surface and a curved outer surface. The funnel 3 is made of glass and connected to the rear part of the face panel 2. The electron gun 5 is provided inside of a neck portion 3*a* of the funnel 3 to emit electron beams. The deflection yoke 6 is attached to the periphery of the funnel 3 to deflect electron beams 4 which are emitted from the electron gun 5. Three-color phosphor dots are coated on the inner surface of the face panel 2 to form a phosphor screen surface 2*a*. The shadow mask 7 is provided substantially parallel to the phosphor screen surface 2*a* in the vicinity of the inner surface of the face panel 2 (the phosphor screen surface 2*a*).

As shown in FIGS. 1 and 2, the shadow mask 7 has a plurality of electron beam through apertures 8 which are arranged regularly, and has the functions of sorting three electron beams 4, which are emitted from the electron gun 5, based on color. Inside the face panel 2, a pair of support frames 9 including of an upper part and a lower part for holding the shadow mask 7, and having an L-shaped sectional form, are provided. The front side of the pair of support frames 9 (the narrow surface at a side of the phosphor screen surface 2*a*) protrudes toward the side of the phosphor screen surface 2*a* to form a circular arc with a predetermined radius of curvature. The upper and the lower edges of the shadow mask 7 are welded to the circular arc surface of the pair of support frames 9. According to the above-mentioned configuration, the shadow mask 7 is curved along the longer axis and is fixed to the pair of support frames 9. At the both sides of the pair of support frames 9, spring members 10 are provided to separate the upper and lower support frames 9 each other. According to the above-mentioned constitution, a predetermined tension can be applied to the shadow mask 7 vertically by the pair of support frames 9.

During the operation of a color picture tube 1, when electron beams 4 are emitted from an electron gun 5, about 80% of the electron beams 4 strike a shadow mask 7, the energy of the electron beams is converted into the thermal energy, and the shadow mask 7 absorbs the thermal energy.

As a result, the temperature of the surface of the shadow mask 7 reaches to 80–100° C. Consequently, the shadow mask 7 expands thermally due to the temperature increase of the shadow mask 7, and the electron beam through apertures 8 formed on the shadow mask 7 are shifted. Therefore, an actual arrival position on the phosphor screen surface 2*a* of electron beams 4 passing through the electron beam through apertures 8, which are shifted due to the thermal expansion of the shadow mask 7, is shifted from a predetermined arrival position. As a result, the electron beams 4 can't arrive at the phosphor dots formed on the phosphor screen surface 2*a* accurately as predetermined, and irregularity of a color occurs. In order to solve the above-mentioned problem, in general, tension that is higher than the intensity of the thermal expansion due to the temperature increase of the shadow mask is applied to shadow masks other than a press mask so that the positions of electron beam through apertures formed on the shadow mask do not shift from positions of phosphor dots formed on the phosphor screen surface that are supposed to be matched to each other. However, according to the above-mentioned configuration in which tension that is higher than the intensity of the thermal expansion due to the temperature increase of the shadow mask is applied to the shadow mask, a heavy and strong support frame is required, the weight of a color picture tube itself increases and in addition to that, a large-scale machine for holding a shadow mask with tension is required.

Then, in order to reduce the distance by which electron beams shift between a predetermined arrival position and an actual arrival position due to the thermal expansion of the shadow mask caused by absorbing thermal energy that is converted from the energy of electron beams when electron beams strike the shadow mask, and the influence of the shifted distance of electron beams on causing irregularity of a color, the relationship between the shifted distance of electron beams and the intensity of the tension that should be applied to the shadow mask is considered. The present invention utilizes a range of tension applied to the shadow mask by which the degree of irregularity of a color does not matter practically.

Figure 6:
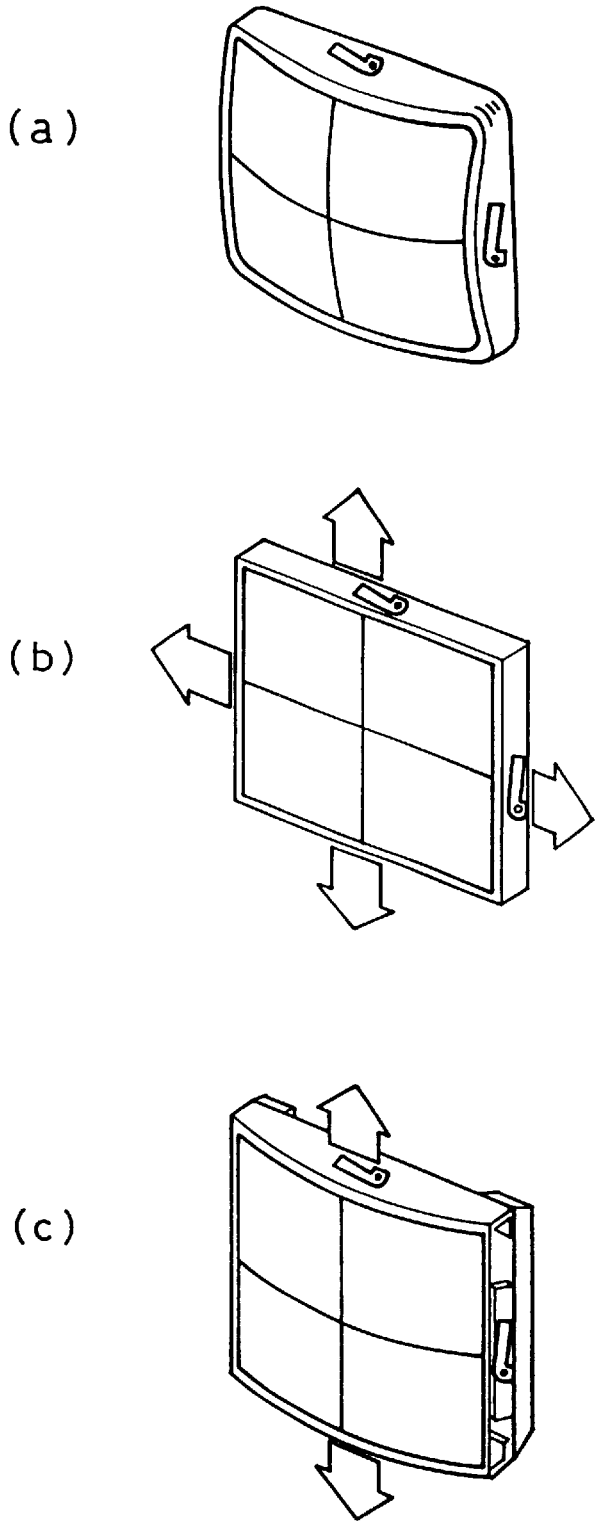
FIG.6 (PRIOR ART)
FIG. 6 is a perspective view showing a conventional shadow mask of a color picture tube.

Hereinafter, in order to reduce the distance by which electron beams shift from a predetermined arrival position to an actual arrival position on the phosphor screen surface and the influence of the shifted distance of electron beams on the irregularity of a color, the relationship between the distance by which electron beams shift between a predetermined arrival position and an actual arrival position on the phosphor screen surface and the intensity of the tension that should be applied will be explained using a shadow mask 7 (that is curved along the longer axis) according to this embodiment. In this case, the tension is applied to the shadow mask 7 along the shorter axis (refer to FIG. 6(*c*)). The distance by which electron beams 4 shift from a predetermined arrival position to an actual arrival position on the phosphor screen surface 2*a* due to the thermal expansion of the shadow mask 7 is designated as "a ($\mu$m)". Then, the tension that is applied to the shadow mask 7 is increased, and when the shifted distance of electron beams becomes zero, the intensity of the tension that is applied to the shadow mask 7 is designated as "A (kg/mm$^2$)". The tension that is larger than A (kg/mm$^2$) was applied to conventional flat masks and cylindrical masks (the condition is so-called "Full tension"). When the tension that is applied to the shadow mask 7 is set to a smaller value than A (kg/mm$^2$), electron beams 4 shift from a predetermined arrival position to an actual arrival position on the phosphor screen surface 2*a* to some extent, however, if the level of the irregularity of a color is not a practical matter, the level is allowable.

The present invention uses, for example, the shadow mask 7 (having a thickness: 0.25 mm and radius of curvature: 7000 mm) made of invar material (coefficient of thermal expansion: $9\times10^{-7}$ deg$^{-1}$), iron material (coefficient of thermal expansion: $118\times10^{-7}$ deg$^{-1}$) or the like and studied the relationship between the distance by which electron beams 4 shift between a predetermined arrival position and an actual arrival position on the phosphor screen surface 2*a* and the intensity of the tension applied to the shadow mask 7. The inventor of the present invention found that when the tension that is applied to the shadow mask 7 is 5–90% of the tension (tension A, that is full tension) when an actual arrival position of electron beams 4 is not shifted from a predetermined arrival position on the phosphor screen surface 2*a* due to the thermal expansion of the shadow mask 7 caused by absorbing thermal energy that is converted from the energy of electron beams when electron beams strike the shadow mask, the degree of irregularity of a color is reduced and the degree of irregularity of a color does not matter practically. In this case, the tension that is applied to the shadow mask 7 made of invar material is 0.3–2.8 (kg/mm$^2$).

As above-mentioned, when the tension applied to the shadow mask 7 is set to 5–90% of the tension when an actual arrival position of electron beams is not shifted from a predetermined arrival position on the phosphor screen surface 2*a* due to the thermal expansion of the shadow mask 7 caused by absorbing thermal energy that is converted from the energy of electron beams when electron beams 4 strike the shadow mask 7, the distance by which electron beams 4 shift between an actual arrival position and a predetermined position on the phosphor screen surface 2*a* become 10–90% of the case when the tension is not applied to the shadow mask 7 at all. Consequently, the level of irregularity of a color becomes low enough so as not to matter practically, and a support frame having a relatively low strength can be used for holding the shadow mask 7 with tension. Consequently the weight of a color picture tube 1 itself can be reduced, and the design for the color picture tube 1 can be simplified.

Further, the tension that is applied to the shadow mask 7 is small, and therefore conventional large-scale machine for holding a shadow mask with tension is not required. Further, the color picture tube can be produced easily without using a pressing mold and a pressing machine which are required for producing a press mask.

Furthermore, the inventor of the present invention found that when the tension applied to the shadow mask 7 is 40–60% of the tension in which an actual arrival position of electron beams 4 is not shifted from a predetermined arrival position on the phosphor screen surface 2*a* due to the thermal expansion of the shadow mask 7 caused by absorbing thermal energy that is converted from the energy of electron beams 4 when electron beams strike the shadow mask 7, the occurrence of the irregularity of a color can be prevented further. In this case, it is preferable that the tension applied to the shadow mask 7 made of invar material is 1–2 (kg/mm$^2$) and it is preferable that the tension applied to the shadow mask 7 made of iron material is 5–12 (kg/mm$^2$).

It is more preferable that the tension is applied to the shadow mask 7 so as to make the shifting distance of electron beams 100 $\mu$m or less between a predetermined arrival position and an actual arrival position on the phosphor screen surface 2*a* due to the thermal expansion of the shadow mask 7 caused by absorbing thermal energy that is converted from the energy of electron beams when electron beams strike on the shadow mask. As above-mentioned, when the tension is applied to the shadow mask 7 to make the shifted distance of electron beams 100 μm or less, the level of the occurrence of irregularity of a color does not matter practically.

Figure 3:
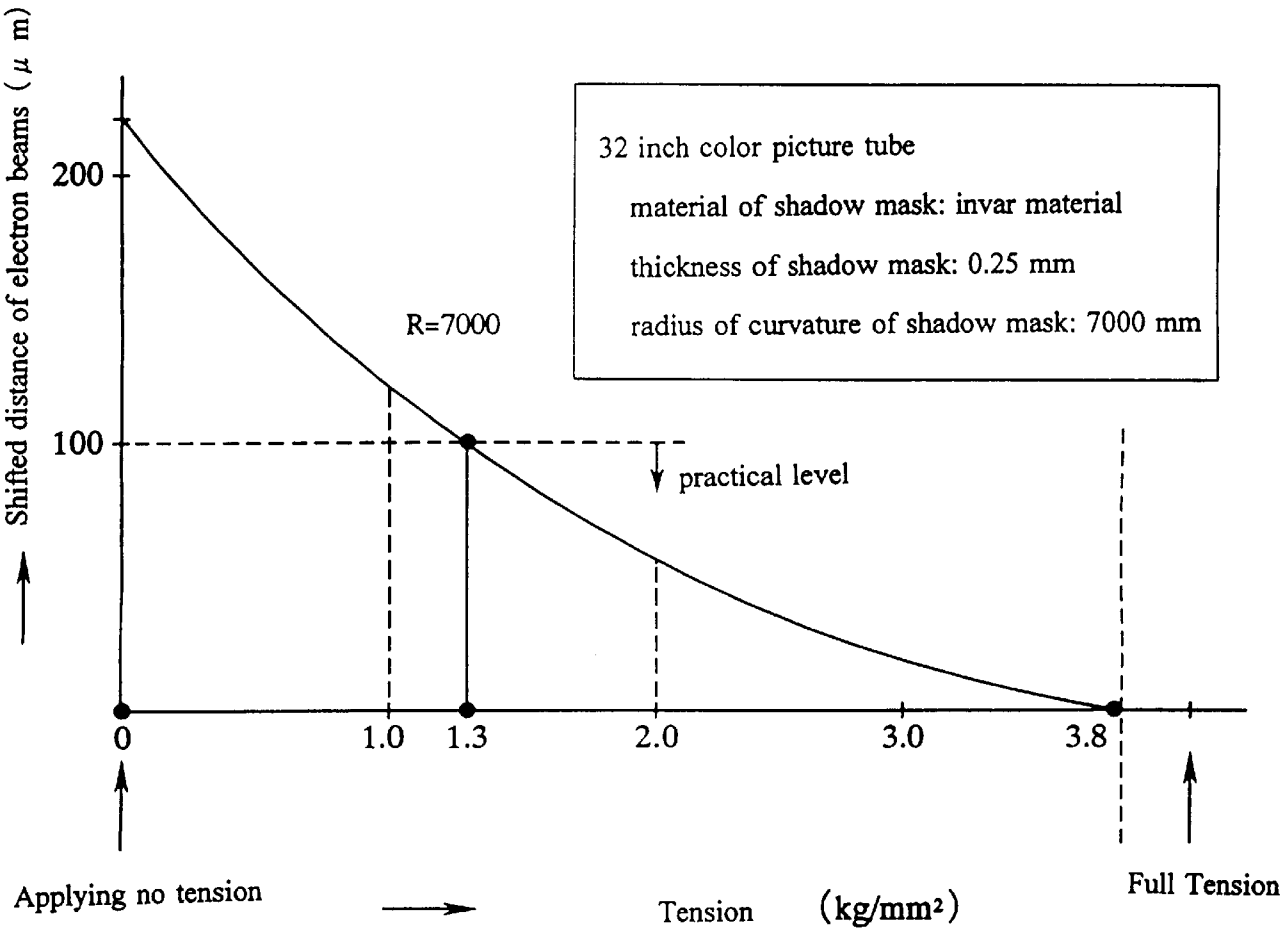
FIG. 3 is a view showing the relationship between the distance by which electron beams shift from a predetermined arrival position to an actual arrival position on the phosphor screen surface and the intensity of the tension that should be applied to the shadow mask of an embodiment of the present invention.

The experimental results of a 32 inch color picture tube to which a shadow mask 7 made of invar material is attached will be shown in FIG. 3.

Although spring members 10 were provided at both sides of a pair of support frames 9 to separate the upper and lower support frames 9 each other, so that a predetermined tension is applied to the shadow mask 7 vertically, the means for generating the tension for the support frame 9 to separate each other is not always limited to this.

Although the means for generating the tension for the support frame 9 was provided in this embodiment, the means for generating the tension for the support frame 9 is not always required to be provided, and the shadow mask 7 to which a predetermined tension is applied may be welded to the support frame 9.

Although a shadow mask 7 that was curved along the longer axis was used to explain the example in this embodiment, the configuration of the shadow mask is not limited to this. A shadow mask that is curved along the shorter axis, or a flat shadow mask may be applied to the present invention. In this case, when the shadow mask curved along the shorter axis is applied to the present invention, the tension is required to be applied along the longer axis, and when the flat shadow mask is applied to the present invention, the tension is required to be applied along at least one of the axes.

Figure 4:
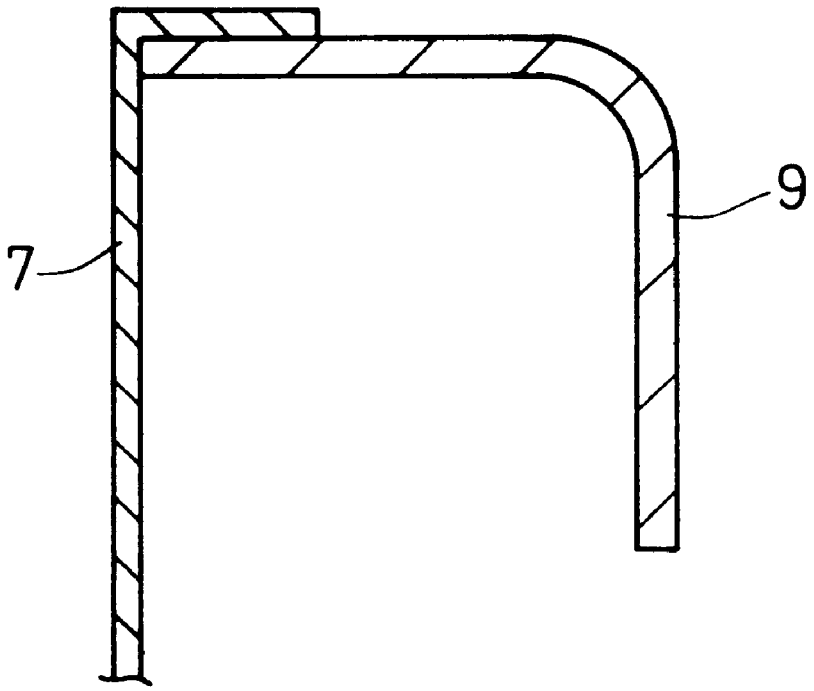
FIG. 4 is a sectional view showing another example of a method for attaching a shadow mask according to an embodiment of the present invention.
Figure 5:
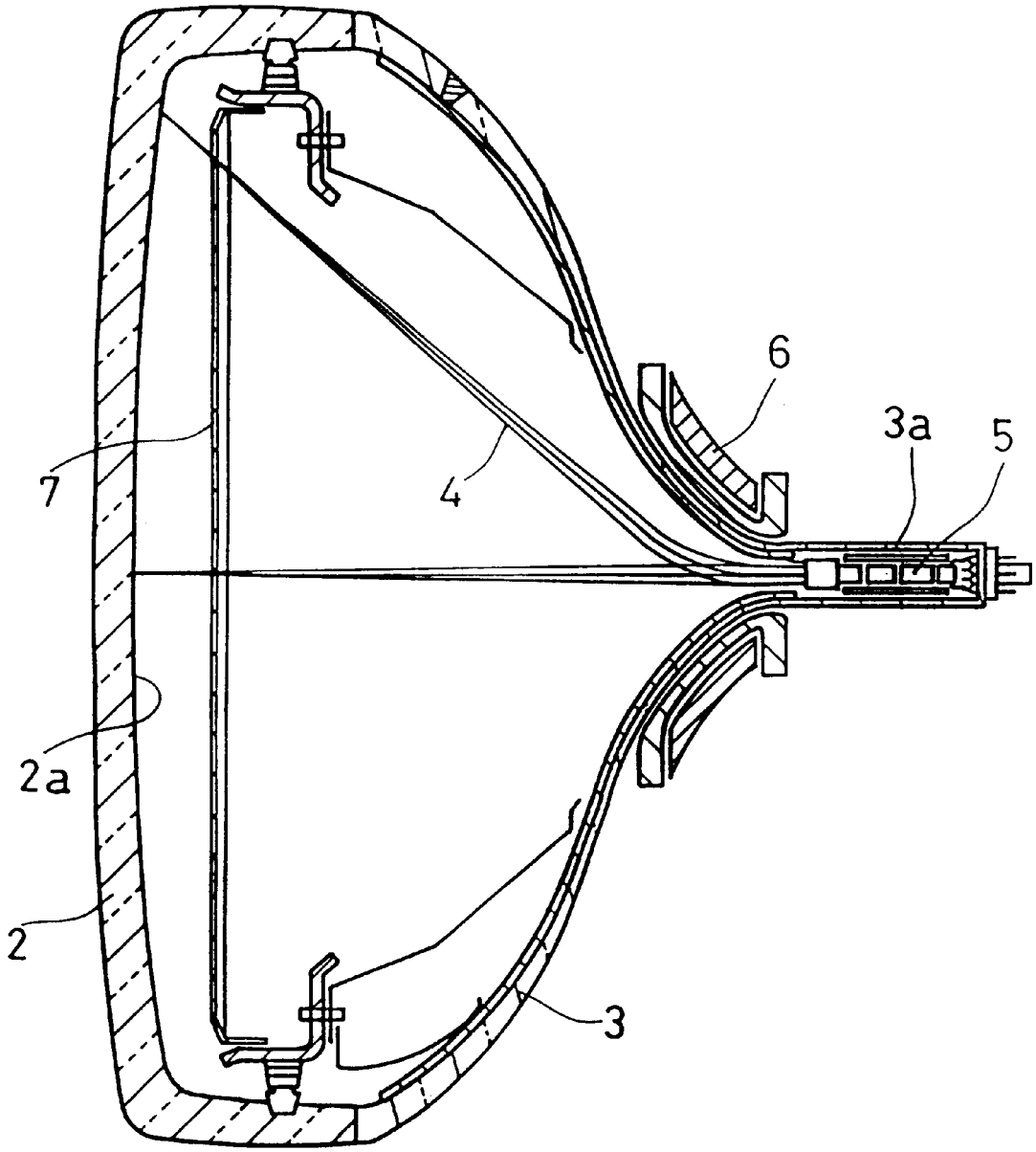
FIG.5 (PRIOR ART)
FIG. 5 is a vertical sectional view showing a conventional color picture tube.

Although the shadow mask 7 was fixed to a pair of support frames 9 by welding the upper and lower edges of the shadow mask 7 to the front side of the pair of support frames 9 (the narrow surface at a side of the phosphor screen surface 2*a*) in this embodiment, the method for fixing the shadow mask 7 to the pair of support frames 9 is not limited to this. For example, as shown in FIG. 4, the upper and lower edges of the shadow mask 7 are bent to form skirt portions and a pair of support frames 9 may be inserted at the inner part of the skirt portions.

Although a color picture tube 1 comprising a face panel 2 having a curved inner surface and a curved outer surface was used to explain the example in this embodiment, the configuration of the color picture tube is not limited to the color picture tube 1 comprising the face panel 2 having the above-mentioned configuration. A face panel having a flat inner surface and a flat outer surface; having a flat outer surface and an inner surface that is curved along the longer axis or curved along the shorter axis; and having an inner surface and an outer surface which are curved along the longer axis or curved along the shorter axis and the like may be applied to the present invention.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A color picture tube comprising:

a face panel having a phosphor screen surface formed inside;

a funnel that is connected to the rear part of the face panel;

an electron gun that is provided inside of a neck portion of the funnel;

a shadow mask that has a plurality of electron beam through apertures for passing electron beams which are emitted from the electron gun, the shadow mask being positioned at a predetermined distance from the phosphor screen surface, wherein tension is applied to the shadow mask so that the shadow mask has a tension that is 5–90% of the tension that would be applied to the shadow mask to prevent electron beams from arriving at a position that is shifted from a predetermined position on the phosphor screen surface due to the thermal expansion caused by absorbing thermal energy that is converted from the energy of electron beams when electron beams strike the shadow mask;

and a frame for attaching the shadow mask, wherein the shadow mask is welded to the frame with a predetermined tension, the frame comprising an upper frame and a lower frame and means for generating tension to hold the shadow mask, the means for generating tension comprising spring members separating the upper and lower frames at both sides of a pair of frames, wherein the pair of frames comprising the upper and lower frames has an L-shaped cross-section and is provided along only a longer axis of the shadow mask, and wherein each end portion of the spring members is inserted into an inner surface of the L-shape of the frame.

2. The color picture tube according to claim 1, wherein the tension is applied to the shadow mask so that the shadow mask has the tension that is 40–60% of the tension that would be applied to the shadow mask to prevent electron beams from arriving at a position that is shifted from a predetermined position of the phosphor screen surface due to the thermal expansion caused by absorbing thermal energy that is converted from the energy of electron beams when electron beams strike the shadow mask.

3. The color picture tube according to claim 1, wherein the tension is applied to the shadow mask so that the maximum distance by which electron beams shift between a predetermined arrival position and an actual arrival position on the phosphor screen surface due to the thermal expansion of the shadow mask caused by absorbing thermal energy that is converted from the energy of electron beams when electron beams strike the shadow mask is 100 μm or less.

4. The color picture tube according to claim 1, wherein the shadow mask is made of invar material and the tension that is applied to the shadow mask is 1–2 $kg/mm^2$.

5. The color picture tube according to claim 1, wherein the shadow mask is flat.

6. The color picture tube according to claim 1, wherein the shadow mask is curved along a longer axis or along a shorter axis.

7. The color picture tube according to claim 1, wherein an inner surface and an outer surface of the face panel are flat.

8. The color picture tube according to claim 1, wherein the inner surface and the outer surface of the face panel are curved.

9. The color picture tube according to claim 1, wherein the inner surface and the outer surface of the face panel are curved along the longer axis or along the shorter axis.

10. The color picture tube according to claim 1, wherein the outer surface of the face panel is flat and the inner surface of the face panel is curved.

11. The color picture tube according to claim 1, wherein the outer surface of the face panel is flat and the inner surface of the face panel is curved along the longer axis or along the shorter axis.

* * * * *